US007595760B2

(12) United States Patent
Lee et al.

(10) Patent No.: US 7,595,760 B2
(45) Date of Patent: Sep. 29, 2009

(54) AIRSHIP MOUNTED ARRAY

(75) Inventors: Jar J. Lee, Irvine, CA (US); Clifton Quan, Arcadia, CA (US); Stanley W. Livingston, Fullerton, CA (US)

(73) Assignee: Raytheon Company, Waltham, MA (US)

( * ) Notice: Subject to any disclaimer, the term of this patent is extended or adjusted under 35 U.S.C. 154(b) by 139 days.

(21) Appl. No.: 11/499,593

(22) Filed: Aug. 4, 2006

(65) Prior Publication Data

US 2008/0030413 A1 Feb. 7, 2008

(51) Int. Cl.
*H01Q 1/28* (2006.01)
*H01Q 19/06* (2006.01)

(52) U.S. Cl. ..... 343/708; 343/754

(58) Field of Classification Search ..... 343/705, 343/706, 707, 754, 755, 915, 708, 753
See application file for complete search history.

(56) References Cited

U.S. PATENT DOCUMENTS 4,044,360 A * 8/1977 Wolfson et al. ..... 343/754
4,491,845 A * 1/1985 Rothenberg ..... 343/754
4,939,527 A 7/1990 Lamberty et al.
5,027,125 A 6/1991 Tang
5,389,939 A 2/1995 Tang et al.
5,990,836 A 11/1999 Bhattacharyya
6,081,232 A * 6/2000 Pittman et al. ..... 342/368
6,351,247 B1 2/2002 Linstrom et al.
6,384,787 B1 5/2002 Kim et al.
6,404,377 B1 6/2002 Lee et al.
6,421,021 B1 * 7/2002 Rupp et al. ..... 343/753
6,650,304 B2 11/2003 Lee et al.
6,714,163 B2 3/2004 Navarro et al.
6,788,268 B2 9/2004 Chiang et al.
7,224,322 B1 * 5/2007 Ghaleb et al. ..... 343/915
7,336,232 B1 2/2008 Lee et al.
7,522,095 B1 * 4/2009 Wasiewicz et al. ..... 342/160
2003/0117327 A1 6/2003 Navarro et al.
2003/0222811 A1 12/2003 Halsey et al.
2004/0164915 A1 * 8/2004 Quan et al. ..... 343/754
2006/0170608 A1 8/2006 Hedrick
2008/0030416 A1 2/2008 Lee et al.
2008/0030420 A1 2/2008 Lee et al.

FOREIGN PATENT DOCUMENTS

DE 195 11 982 A1 10/1996
FR 2 867 614 A 9/2005

OTHER PUBLICATIONS

PCT International Search Report and Written Opinion of ISA, mailed Mar. 28, 2008, Int'l App No. PCT/US2007/017216.

* cited by examiner

*Primary Examiner*—Hoang V Nguyen
*Assistant Examiner*—Robert Karacsony
(74) *Attorney, Agent, or Firm*—Leonard A. Alkov

(57) ABSTRACT

A space-fed conformal array for a high altitude airship includes a primary array lens assembly adapted for conformal mounting to a non-planar airship surface. The lens assembly includes a first set of radiator elements and a second set of radiator elements, the first set and the second set spaced apart by a spacing distance. The first set of radiators faces outwardly from the airship surface to provide a radiating aperture. The second set of radiators faces inwardly toward an inner space of the airship, for illumination by a feed array spaced from the second set of radiators.

23 Claims, 11 Drawing Sheets

FIG. 1
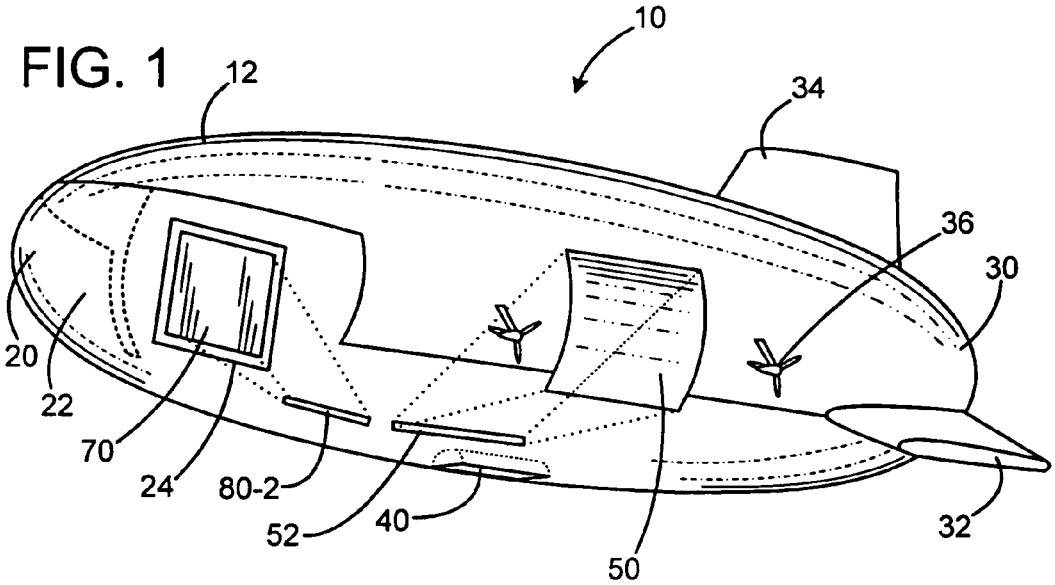
FIG. 2A
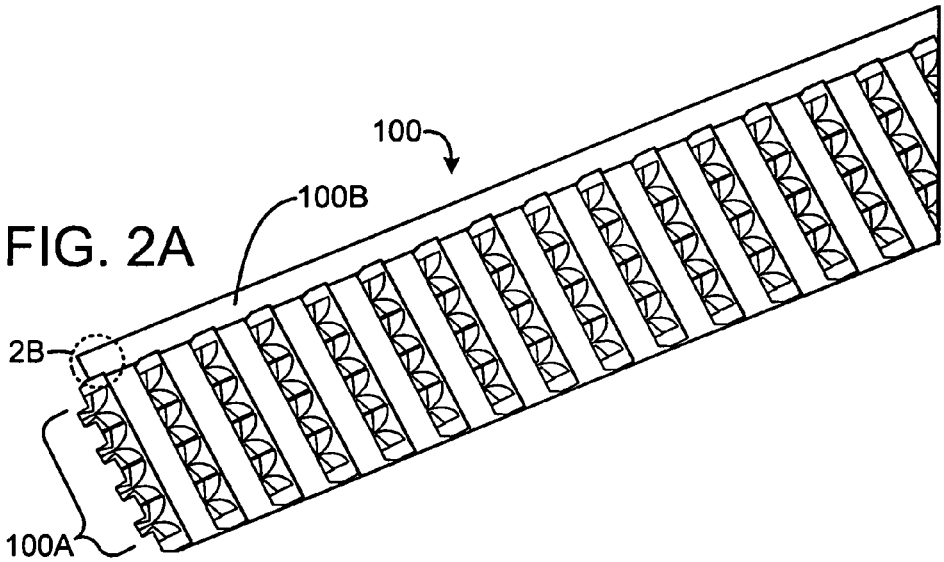
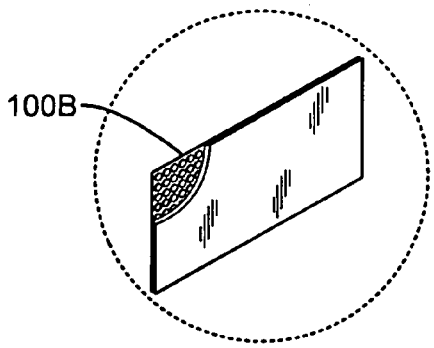
FIG. 2B

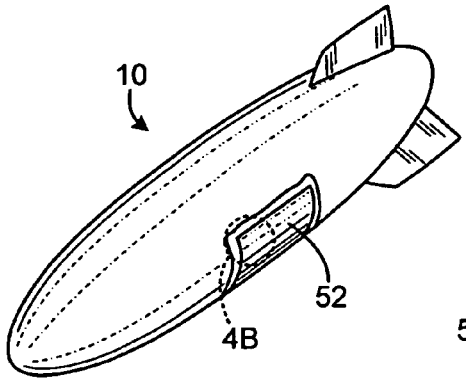
FIG. 4A
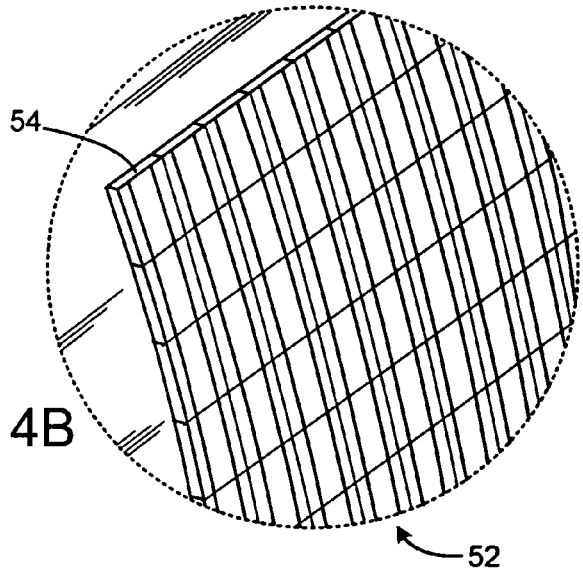
FIG. 4B
FIG. 4C
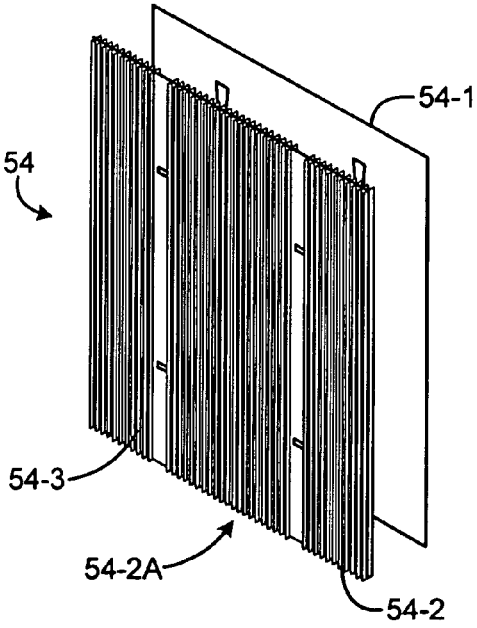
FIG. 4D
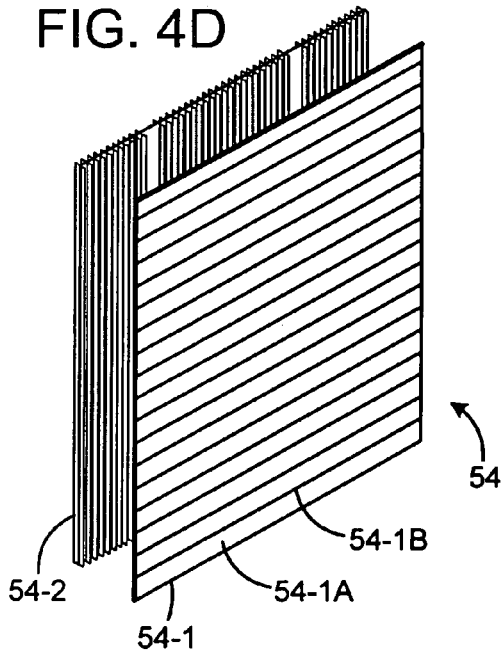

FIG. 8
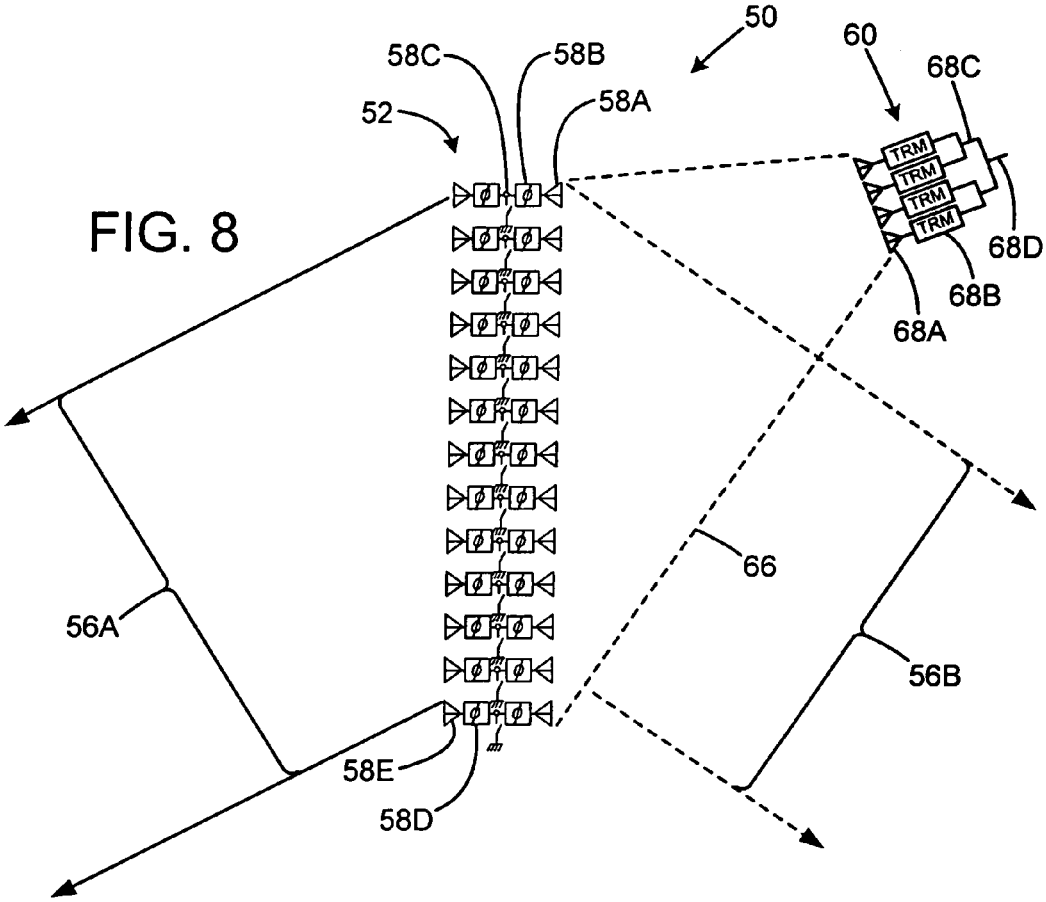
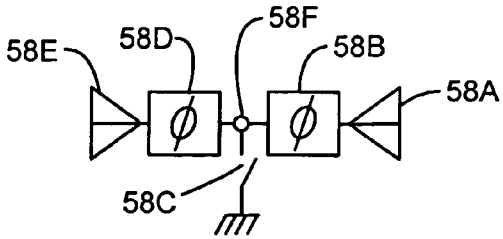
FIG. 8A

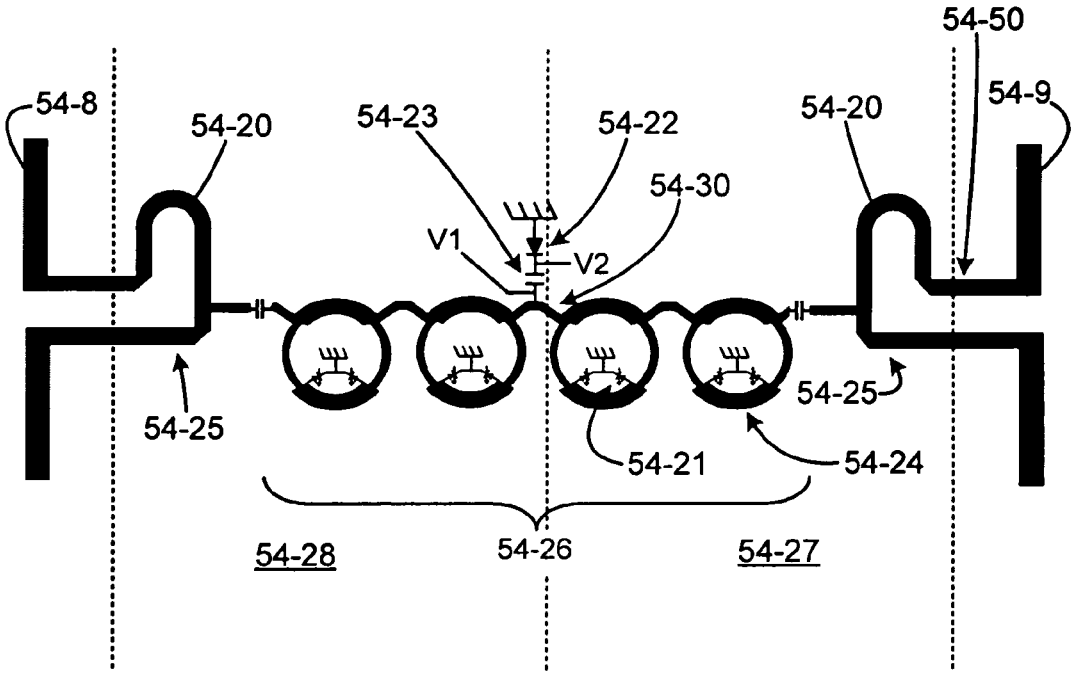
FIG. 11
FIG. 12A
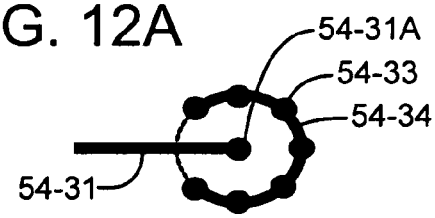
FIG. 12B
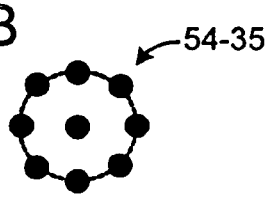
FIG. 12C
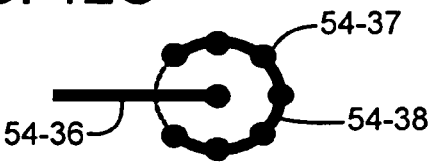
FIG. 12
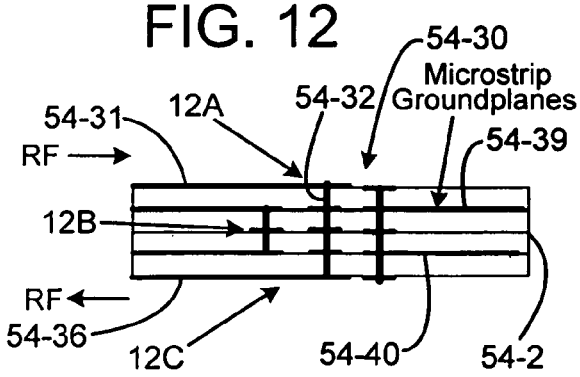

AIRSHIP MOUNTED ARRAY

This invention was made with Government support under Contract No. HR0011-04-C-0096 awarded by the Defense Advanced Research Projects Agency. The Government has certain rights in this invention.

BACKGROUND

Airborne sensor arrays provide challenges in terms of weight and power limitations. Reducing weight and power requirements is a typical objective for airborne and space sensor arrays.

SUMMARY OF THE DISCLOSURE

A space-fed conformal array for a high altitude airship includes a primary array lens assembly adapted for conformal mounting to a non-planar airship surface. The lens assembly includes a first set of radiator elements and a second set of radiator elements, the first set and the second set spaced apart by a spacing distance. The first set of radiators faces outwardly from the airship surface to provide a radiating aperture. The second set of radiators faces inwardly toward an inner space of the airship, for illumination by a feed array spaced from the second set of radiators.

BRIEF DESCRIPTION OF THE DRAWINGS

FIG. 1 shows an exemplary airship in simplified isometric view.

FIG. 2A illustrates an exemplary feed array for dual band operation. FIG. 2B illustrates a fragment of an X-band feed array portion of the dual band feed array.

FIG. 4A is an isometric view of an airship with a conformal side array positioned on one flank. FIG. 4B is an enlarged view of a portion of the airship and array within circle 5B depicted in FIG. 4A, depicting some of the tile panels. FIG. 4C is an isometric view of one tile panel, depicting its front face. FIG. 4D is an isometric view similar to FIG. 4C, but depicting the back face of the tile panel.

FIG. 8 is a schematic diagram of a space-fed array operable either as a feed through lens array or a reflective array. FIG. 8A illustrates one set of 180 degree phase shifters of the array of FIG. 8, connected through a switch.

FIG. 11 is a schematic diagram of an exemplary embodiment of X-band lens array circuitry.

FIGS. 12 and 12A-12C are schematic diagrams illustrating an exemplary embodiment of an RF connection in the form of a caged coaxial interconnect line between respective phase shifter circuit halves.

DETAILED DESCRIPTION

Figure 2:
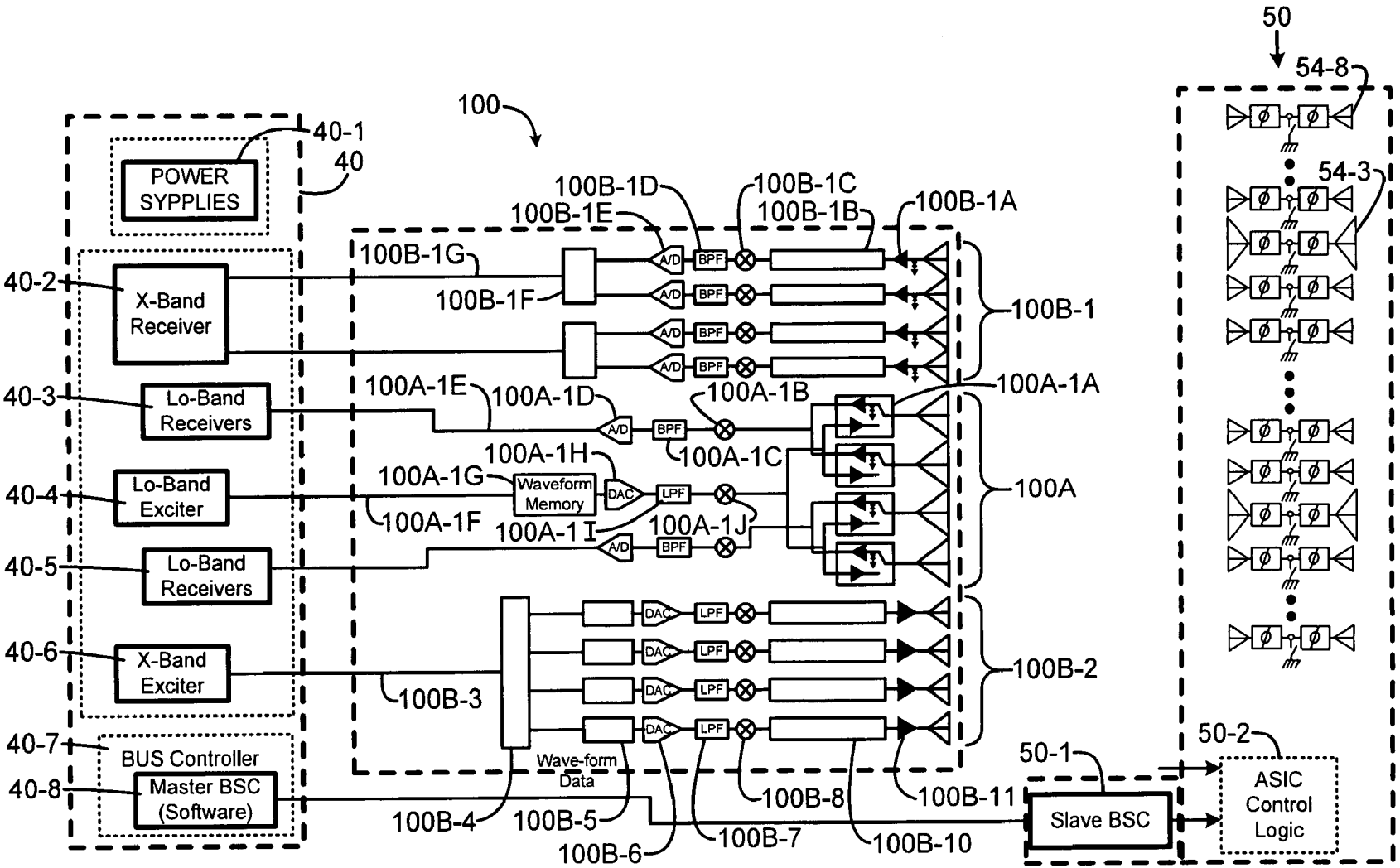
FIG. 2 is a simplified schematic block diagram illustrating a dual band electronically steerable array (ESA) system suitable for use on the airship of FIG. 1.

In the following detailed description and in the several figures of the drawing, like elements are identified with like reference numerals. The figures are not to scale, and relative feature sizes may be exaggerated for illustrative purposes.

An exemplary vehicle on which a sensor or antenna array may be installed is an airship, i.e. a lighter-than-air craft. Antenna arrays and components described below are not limited to this application, however. For the sake of this example, the airship may be a stratospheric craft on the order of 300 meters in length. The airship may be preferably semi-rigid or non-rigid in construction. The airship may include an outer balloon structure or skin which may be inflated, with internal ballonets filled with air to displace helium in the airship for airlift control.

FIG. 1 shows an exemplary airship in simplified isometric view. The airship 10 includes an outer skin surface 12, a nosecone region 20, a stern region 30, horizontal fins 32 and a vertical tail fin 34. Propulsion pods 36 are provided and may include propellers and drive units. An avionics and systems bay 40 is provided on the underbelly of the airship. The interior of the airship may include a helium bay portion 22 separated from the remainder of the interior by a bulkhead 24.

In an exemplary embodiment, the airship 10 carries a space-fed dual band antenna, comprising a plurality of arrays. In an exemplary configuration, the space-fed dual band antenna arrays may each operate as a feed-through lens or reflective array. In this exemplary embodiment, one conformal array 50 is installed with a primary array 52 on a flank of the airship to provide antenna coverage of the left and right side relative to the airship, and one planar array 70 with a primary array 72 (FIG. 3A) on the bulkhead 24 in a nose region to cover the front and back regions relative to the airship. In an exemplary embodiment, the primary array of the side array 50 may measure on the order of 25 m×40 m, while the primary array 72 (FIG. 4A) of the planar array 70 in the nosecone region may be about 30 m×30 m in size.

In an exemplary embodiment, each of the space-fed arrays employs a dual-band shared aperture design. An exemplary embodiment of a lens array includes two facets, a pick-up side with the elements facing the feed (power source) and the radiating aperture. A space-fed design may simplify the feed network and reduce the RF insertion and fan-out loss by distributing the RF power through the free space to a large number of radiating elements (4 million for X-band, and about 6000 for a UHF band in one exemplary embodiment). DC and low power beam scan digital command circuitry may be sandwiched inside the lens array in an exemplary embodiment. The RF circuit portion may be separated from the DC and digital electronics circuit portion.

FIG. 2 is a simplified schematic block diagram illustrating a dual band electronically steerable array (ESA) system suitable for use on the airship 10. The avionics bay 40 has mounted therein a set of power supplies 40-1, high band (X-band) receivers 40-2, low band (UHF) receivers 40-3 and 40-5, a low band exciter 40-4, an X-band exciter 40-6, and a controller 40-7 including a master beam steering controller (BSC) 40-8. The receivers and exciters are connected to the feed array 100. In this exemplary embodiment, the X-band feed array 100B is divided into a receive channel including a set 100B-1 of radiator elements, and a transmit channel including a set 100B-2 of radiator elements.

In an exemplary embodiment, the receive channel includes, for each radiator element 100B-1, a low noise amplifier, e.g. 100B-1A, whose input may be switched to ground during transmit operation, an azimuth RE feed network, e.g. network 100B-1B, a mixer, e.g. 100B-1C, for mixing with an IF carrier for down converting received signals to baseband, a bandpass filter, e.g. 100B-1D, and an analog-to-digital converter (ADC), e.g. 100B-1E, for converting the received signals to digital form. The digitized signals from the respective receive antenna elements 100B-1 are multiplexed through multiplexers, e.g. multiplexer 100B-1F and transmitted to the X-band receivers 40-2, e.g., through an optical data link including fiber 100B-1G.

In an exemplary embodiment, the transmit X-band channel includes an optical fiber link, e.g. fiber 100B-3, connecting the X-band exciter 40-6 to an optical waveform control bus, e.g. 100B-4, having outputs for each set of radiating elements 100B-2 to respective waveform memories, e.g. 100B-5, a digital-to-analog converter, e.g. 100B-6, a lowpass filter, e.g. 100B-7, an upcoverting mixer 100B-8, an azimuth feed network 100B-10, coupled through a high power amplifier, e.g. 100B-11 to a respective radiating element. The control bus may provide waveform data to the waveform memory to select data defining a waveform.

In an exemplary embodiment, the low-band feed array includes a transmit/receive (T/R) module, e.g. 100A-1A, for each low-band radiator element, coupled to the respect receive and transmit low-band channels. The T/R modules each include a low noise amplifier (LNA) for receive operation and a high power amplifier for transmit operation. The input to the low noise amplifiers may be switched to ground during transmit operation. In an exemplary embodiment, the outputs from adjacent LNAs may be combined before downconversion by mixing with an IF carrier signal, e.g. by mixer 100A-1B. The downconverted signal may then be passed through a bandpass filter, e.g. 100A-1C, and converted to digital form by an ADC, e.g. 100A-1D. The digitized received signal may then be passed to the low band receivers, e.g. 40-3, for example by an optical data link including an optical fiber 100A-1E.

In an exemplary embodiment, the transmit low-band channel includes the low band exciter 40-4, a waveform memory 100A-1G, providing digital waveform signals to a DAC, e.g. 100A-1H, a low pass filter, e.g. 100A-1I, and an upconverting mixer, e.g. 100A-1J, providing a transmit signal to the T/R module for high power amplification and transmission by the low band radiating elements of the array 100A.

FIG. 2 also schematically depicts an exemplary lens array, in this case array 50, which is fed by the feed array 100. The array 50 includes the pick up array elements on the side facing the feed array, and the radiating aperture elements facing away from the feed array. Exemplary embodiments of feed arrays will be described in further detail below.

FIG. 2A illustrates a fragment of an exemplary feed array 100 for dual band operation, showing exemplary low band radiating elements and high band radiating elements. This example includes 4-8 rows of radiating elements spaced and weighted to produce a proper feed pattern in the elevation (EL) plane with minimum spillover and taper loss. This is a practice known to a skilled designer and is similar to a situation encountered in a reflector antenna design. For example, the array 100 includes a UHF feed array 100A, comprising 4 rows of radiating elements 100A-1. An exemplary suitable radiating element is a flared notch dipole radiating element described, for example, in U.S. Pat. No. 5,428,364. The rows of radiating elements have a longitudinal extent along the airship axis. The array 100 further includes an X-band feed array 100B, arranged along a top edge of the UHF feed array 100A. The X-band feed array may, in an exemplary embodiment, be a scaled version of the UHF feed array 100A, and similar radiating elements may be employed in the X-band feed array 100B as for the UHF array. Other radiating elements may alternatively be employed, e.g. radiating patches or slots. In an exemplary embodiment, the X-band array 100B has a longitudinal extent which may the same length as the UHF array, but its height is much smaller, since the size of the radiating elements are scaled down to the wavelength of a frequency in the X-band.

FIG. 2B shows a fragmentary, broken-away portion of the X-band array 100B, with an array of radiating elements 100B-1. The top layer 100B-2 may be a protective dielectric layer or cover.

The feed array 100 is oversized in length along the airship axis, about 48 m in this embodiment; so that signals returned from a wide region in the azimuth (horizontal) direction may be focused in the feed region with minimal spillover. In an exemplary embodiment, the signals include multiple beams synthesized by a digital beam former, e.g. beamformer 40-8 (FIG. 2).

Feed location and the structural support for the placement of the feed array may be traded off, based on the consideration of factors such as instantaneous bandwidth, construction issues of the airship and weight distribution.

Figure 3A:
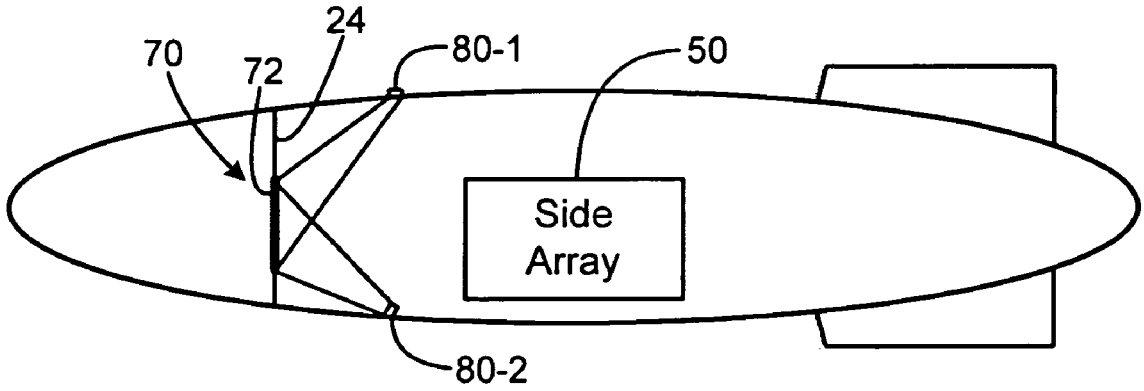
FIG. 3A diagrammatically illustrates two exemplary feed locations for an exemplary nose cone planar array.

FIG. 3A diagrammatically illustrates two exemplary feed locations for the nose cone planar array 70. For this array, the primary lens array 72 is mounted on the bulkhead 24, which is generally orthogonal to the longitudinal axis of the airship. One exemplary location for the feed array 80 for this array is at the top of the outer surface of the airship skin, and is denoted by reference 80-1. A second exemplary location for the feed array for planar array 70 is at the bottom of the airship, denoted by reference 80-2. In an exemplary embodiment, the feed array is oversized in length with respect to the primary array, e.g. 20% longer than a 30 m length of the primary array. In an exemplary embodiment, the feed array may be mounted on the outside of the airship. The feed array may be curved to conform to the outer surface of the airship, and phase corrections may be applied to the feed array to compensate for the curvature.

Figure 3B:
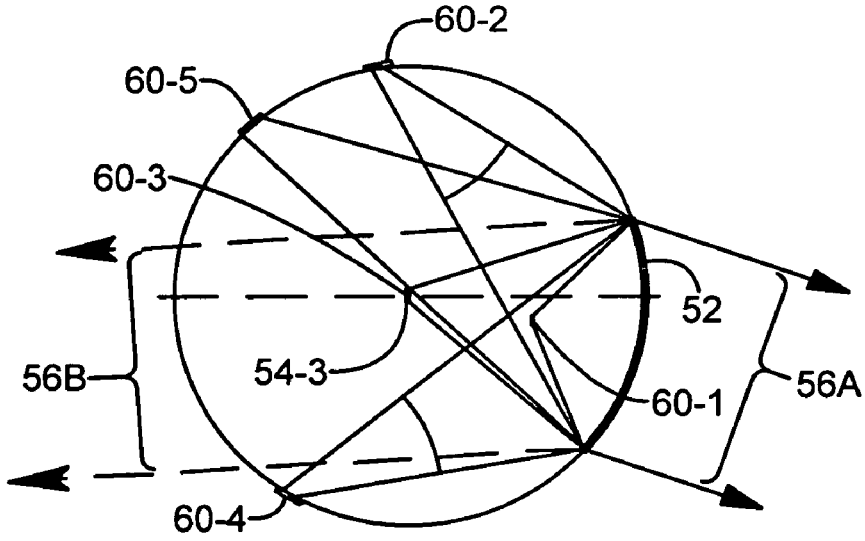
FIG. 3B diagrammatically illustrates several exemplary locations for a feed array for an exemplary conformal side array.

FIG. 3B diagrammatically illustrates several exemplary locations for the feed array 54 for the conformal side array 50. For this array, the primary lens array 52 is mounted on a flank of the skin surface of the airship. The feed array 60 may be mounted at one of many locations, to produce a feed-through beam 56A and a reflected beam 54B. For example, one exemplary feed array 60-1 is located within the interior space of the airship. The feed array 60-1 may be implemented with a relatively small feed array, less than one meter in height in one exemplary embodiment, which may be relatively light and with a wide bandwidth, and provides a relatively small blockage profile for energy reflected by the primary array 52. Feed array 60-2 is mounted on the skin surface of the airship, at a location close to the top of airship. Feed array 60-3 is mounted within the interior space of the airship, at approximately a center of the interior space facing the primary feed array. The location of 60-3 may be undesirable for ballonet airship construction. Another location is that of feed array 60-4, on a lower quadrant of the skin surface on a side of the airship opposite that of the primary feed array. This location may provide good weight management, but may be undesirable in terms of bandwidth. A fifth location is that of feed array 60-5, which is located on the same side of the airship as feed array 60-4 but in the upper quadrant.

For some applications, the location of feed array 60-5 may provide better performance relative to the locations of feed arrays 60-1 to 60-4. Depending on the location of the feed array, different electrical lengths to the respective top and bottom edges of the primary array from the feed array may create different time delays, making it more difficult to use phase shifters to correct for the different path lengths. Location 60-5 results in fairly closely equal path lengths (from feed array to top of primary array and to bottom of feed array.

Figure 5:
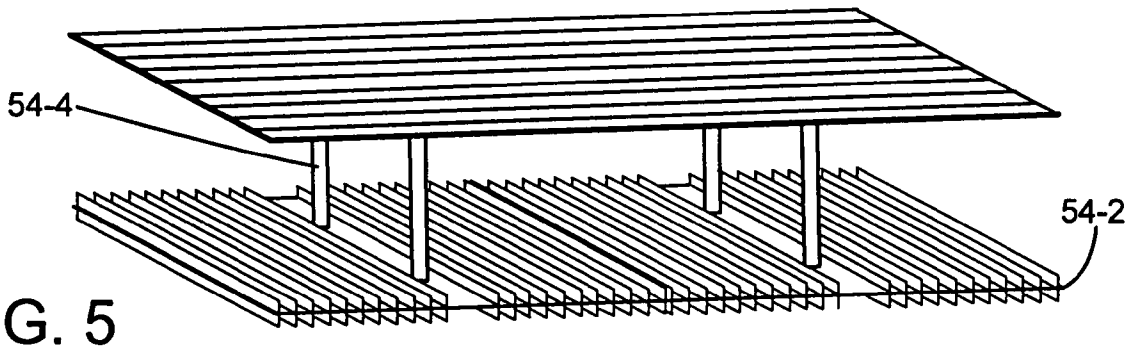
FIG. 5 is an isometric view of a tile panel, illustrating structural stand offs and twin lead feed lines connecting to vertical bow-tie UHF dipole elements.

In an exemplary embodiment, the flank-mounted dual-band aperture 50 includes a primary array 52 formed by many one-square-meter tile panels 54, as shown in FIG. 5, e.g. one thousand of the tile panels for a one thousand square meter aperture size. In this example, the array 52 is 25 m by 40 m, although this particular size and proportion is exemplary; other primary arrays could have tiles which are larger or smaller, and be composed of fewer or larger numbers of tiles. The tiles may be attached to the outer skin of the airship, e.g., using glue, tie-downs, rivets, snap devices or hook and loop attachments. One exemplary material suitable for use as the skin is a 10 mil thick fluoropolymer layer with internal Vectran™ fibers. Another exemplary skin material is polyurethane with Vectran™ fibers.

FIG. 4A is an isometric view of the airship 10 with the conformal side array 52 positioned on one flank. FIG. 4B is an enlarged view of a portion of the airship and array within circle 4B depicted in FIG. 4A, depicting some of the tile panels 54.

FIG. 4C is an isometric view of one tile panel 54, depicting the front face of the tile panel. FIG. 4D is an isometric view similar to FIG. 4C, but depicting the back face of the tile panel 54.

Figure 6:
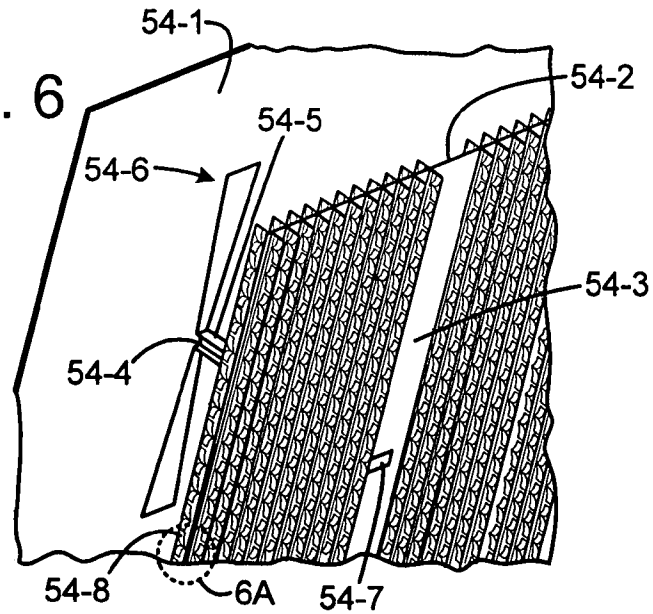
FIG. 6 is a close-up isometric view of a portion of the tile panel of FIG. 5.

FIG. 4C illustrates features of an exemplary UHF band lens assembly, comprising spaced dielectric substrates 54-1 and 54-2. In an exemplary embodiment, the substrates 54-1 and 54-2 may be fabricated on flexible circuit boards. In an exemplary embodiment for a UHF band, the substrates are spaced apart a spacing distance of 15 cm. Fabricated on the front face 54-2A of substrate 54-2 are a plurality of spaced long slot radiators 54-3. The radiators are elongated slots or gaps in a conductive layer pattern. The slots 54-3 may be formed in the conductive layer on the front surface by photolithographic techniques. In an exemplary UHF embodiment, the slots have a relatively large width, e.g. 4 cm, which allows room to place UHF circuit devices, e.g phase shifter and switch structures, in the slot opening. In one exemplary embodiment, the radiator slots are fed by probes, e.g. probes 54-7 (FIG. 7) coupled to dipole pick up elements 54-6 (FIG. 6). In an exemplary embodiment, the long slot radiators are disposed at an orthogonal polarization relative to the dipole pick up elements. Long slot radiators as described in US 2005/0156802 may be employed in an alternate embodiment.

FIG. 4D illustrates the back face of the tile 54, and features of an X-band lens assembly. In an exemplary embodiment, the X-band lens array is fabricated on board assembly 54-2, and may be constructed by standard procedures using multilayer circuit board technology (RF-on-flexible circuit board layers) to package the DC and digital beam control electronics. The total thickness of the X-band lens array assembly is about 2 cm back to back in an exemplary embodiment, for one wavelength at an X-band operating frequency, while the low band aperture is about 17 cm thick, with 15 cm quarter-wave spacing for a wire mesh or grid 54-1B (FIG. 4D) from the long slot radiators.

Still referring to FIG. 4D, the back face 54-1A of substrate 54-1 has formed thereon a wire grid 54-1B. In an exemplary embodiment, the wire grid may be fabricated using photolithographic techniques to remove portions of a conductive layer, e.g., a copper layer, formed on the surface to define separated conductive wires on the dielectric substrate surface. The conductive wires of the grid are disposed in an orthogonal sense relative to the long slot radiators 54-3. The wire grid or thin-wire mesh 54-1B serves as a reflecting ground plane for the long slot radiator elements 54-3. In an exemplary UHF embodiment, the spacing of the thin wires may be about 6 cm, or one tenth of a wavelength at UHF band. The long slots radiate a field horizontally polarized, chosen for the low band applications including foliage penetration. In an exemplary embodiment, the wire grid may have virtually no effect on X-band operation, due to the wide spacing at X-band wavelengths.

Figure 7:
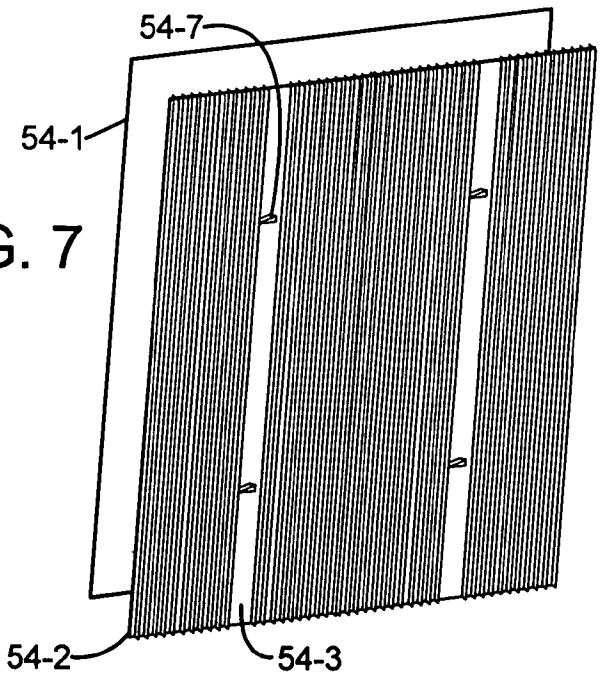
FIG. 7 is an isometric view of a tile panel, diagrammatically illustrating long slot radiators, feed probes and phase shifter electronics.

FIGS. 5-7 illustrate an exemplary dual-band aperture design for the primary array 52 in further detail. FIG. 5 is an isometric view of a tile panel 54, illustrating the separation between the substrates 54-1 and 54-2. and depicting structural stand offs 54-4 between the substrates. FIG. 6 is an inverted close-up isometric view of a portion of the tile panel of FIG. 5, showing a bow-tie dipole element 54-6, a corresponding twin-wire feed line 54-5 and a long slot radiator 54-3. The standoffs are positioned outside the skin of the airship, in an exemplary embodiment. The twin lead feed lines 54-5 connect to respective vertical bow-tie UHF dipole elements 54-6.

Each bow-tie dipole element 54-6 picks up power from the feed array 60, and transfers the power to a long slot element on the front face through a pair of twin-wire feed lines 54-5 with a polarization 90 degree twist. The signal goes through a phase shifter and excites the long slot through a feed probe 54-7. The phase shifter and a lumped element transformer matching the impedance of the radiator at each end are sandwiched in a multi-layer circuit board shared inside the X-band array.

Figure 6A:
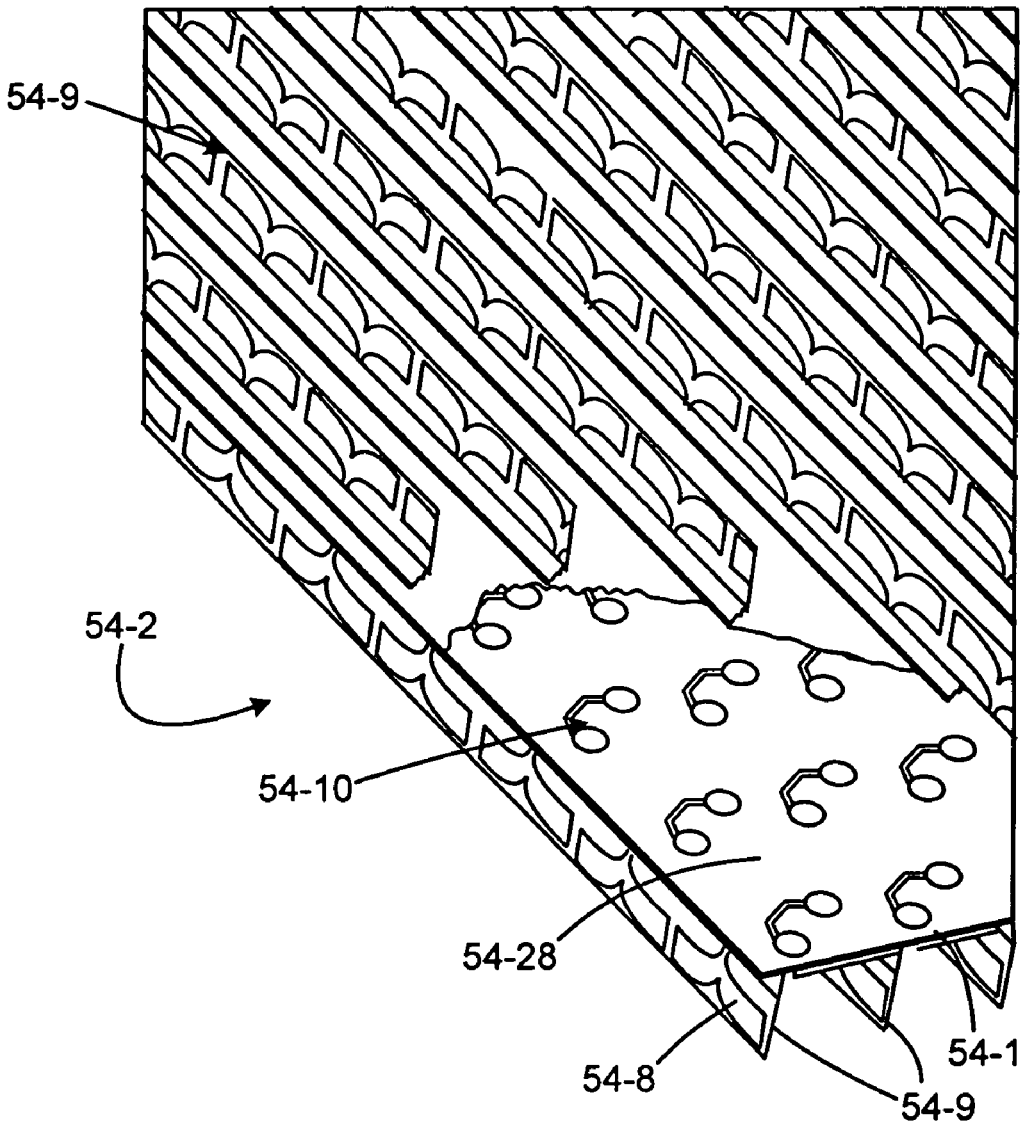
FIG. 6A depicts a fragment of an exemplary embodiment of an X-band lens array formed on a board assembly.

The X-band elements are vertically polarized, and positioned on both the pick-up side and the radiating side of the aperture, as illustrated in FIGS. 6, 6A and 7. Rows of X-band elements 54-8 are fabricated on dielectric substrate strips 54-9 which are supported in parallel, spaced relation on both sides of the substrate 54-1 in an exemplary embodiment. The dielectric substrates 54-9 are attached orthogonally to the substrate 54-1, and extend parallel to the long slot radiators 54-3. The X-band elements 54-8 in an exemplary embodiment may be radiating elements described, for example, in U.S. Pat. No. 5,428,364. An exemplary spacing between the X-band radiator strips 54-9 is one-half wavelength at X-band, about 0.6 inch (1.5 cm).]

FIG. 6A depicts a fragment of an exemplary embodiment of the X-band lens array formed on board assembly 54-1. The X-band radiator strips 54-9 in an exemplary embodiment are each on the order on one cm in height, with a spacing of one half wavelength. The substrate assembly 54-1 may include a multilayer printed circuit board, in which the conductive layer defining the UHF long slot radiators is buried. X-band phase shifter circuits and control layers, generally depicted as 54-10 may also be embedded within the multilayer circuit board assembly. Low band electronics may also be embedded within the multilayer printed circuit board assembly. A ground plane and cover layer 54-11 is disposed between the strips.

In an exemplary embodiment, a polarization twist isolates high band and low band signals, and also between the pick-up side and the radiating side of the lens array. On transmit, both the low band (UHF) and high band (X-band) sources transmit vertically (V) polarized signals to the lens array. The H-polarized mesh ground plane 54-1B is transparent to these transmitted signals. The UHF pick-up elements or dipoles 54-6 pick up the vertically polarized signal, transfers the power through the twin-wire feed 54-5 to excite the long slot 54-3, which radiates an H-polarized wave into space. An H-polarized wave radiates backward, but will be reflected by the orthogonal H-polarized mesh 54-1B.

A polarization twist isolates the pickup side and the radiating side of the UHF lens array, i.e the twist between the dipole pickup elements 54-6 and the long slots 54-3. For X band, there is a ground plane (see FIG. 6A), which isolates the pickup elements on the bottom and the radiating elements on the top. The radiating elements are spaced one quarter wavelength from the groundplane, and the pickup elements are also spaced one quarter wavelength from the ground plane. The grid 54-1B provides a groundplane for the UHF long slot radiators only; the ground plane for the X-band lens also serves as the ground plane for the UHF dipoles. Thus, for the UHF array, the pickup and the radiating elements do not share a common ground plane. Since the dipoles 54-6 are at cross-polarization to the wire grid 54-1B, the dipoles can be located close to the wire grid without impacting performance. Effectively the distance between the pickup elements and the radiating elements may be one-quarter wavelength instead of one-half wavelength, a reduction is size which may be important at UHF frequencies.

FIG. 7 is an isometric view of a tile panel 54, diagrammatically illustrating long slot radiators 54-3, feed probes 54-7 and phase shifter electronics.

In an exemplary embodiment, a space-fed array can be operated as a feed-through lens or as a reflective array, depending on which side of the airship is to be covered. This may be accomplished in an exemplary embodiment by separating the phase shifter circuitry between the pick up and radiating aperture elements into two halves, each providing a variable phase shift between 0 and 180 degrees, and inserting a switch at the mid-point to allow the signal to pass through or be reflected. An exemplary embodiment is depicted in FIG. 8, a schematic diagram of a space-fed array.

FIG. 8 illustrates space-fed array 50, comprising a primary array 52 and a feed array 60. The feed array 60 includes a plurality of feed radiating elements 68A, a plurality of T/R (transmit/receive) modules 68B and a feed network 68C. RF energy is applied at I/O port 68D, and is distributed through the feed network and the T/R modules to the respective feed elements, to form a beam 66 which illuminates the primary array 52. The primary array 52 includes a first side set of radiating elements 58A, a first set of 180 degree phase shifters 58B, a set of switches 58C, a second set of 180 degree phase shifters 58D and a second set of radiating elements 58E.

FIG. 8A illustrates an exemplary embodiment of one set of 0 to 180 degree analog phase shifters 58B, 58D of the array of FIG. 8, connected through a switch 58C. The switch 58C selectively connects the midpoint node 58F between the phase shifters to ground. When in the open position, energy from one set of phase shifter/radiating element passes through the node to the opposite phase shifter/radiating element. This is the feed through mode position. When the switch is closed, creating a short to ground, energy arriving at the midpoint node is reflected by the short circuit, providing a reflection mode.

Figure 8B:
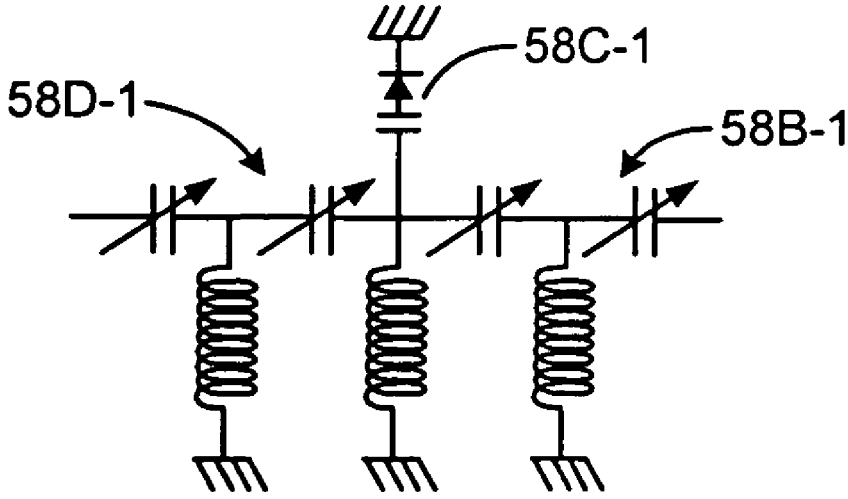
FIGS. 8B-8C are exemplary schematic diagrams of alternate embodiments of a phase shifter/switch set.

FIG. 8B is a simplified schematic diagram of an exemplary embodiment of a switch and phase shifter circuit suitable for implementing the circuit elements of FIG. 8A for the low band (UHF). In this exemplary embodiment, the filters 58B-1 and 58D-1 are implemented as tunable lumped element filter phase shifters, with the tunable elements provided by varactor diodes biased to provide variable capacitance. The switch 58C-1 may be implemented by a shunt diode or MEMS switch. The switches and tunable elements may be controlled by the beam steering controller 50-1 (FIG. 2).

Figure 8C:
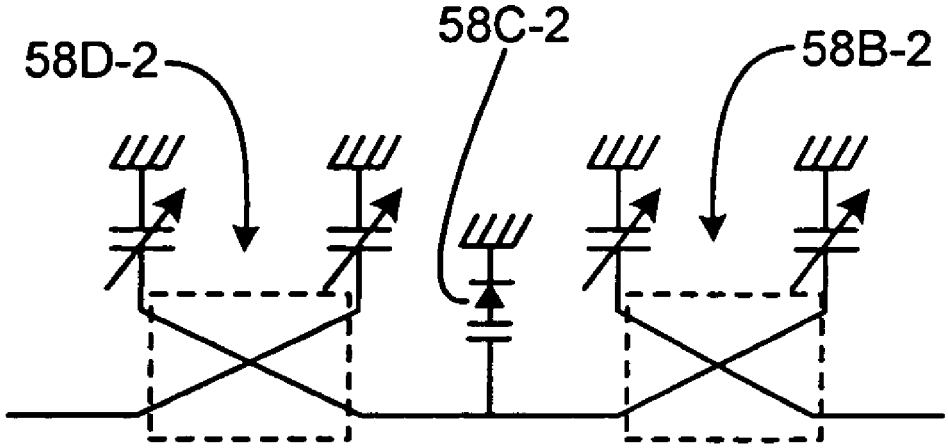

FIG. 8C is a simplified schematic diagram of an exemplary embodiment of a switch and phase circuit suitable for implementing the circuit elements of FIG. 8A for the high band (X-band). In this exemplary embodiment, the filters 58B-2 and 58D-2 are implemented as reflection phase shifters each comprising a 3 dB hybrid coupler and varactor diodes to provide variable capacitance. Reflection phase shifters are described, for example, in U.S. Pat. No. 6,741,207. The switch 58C-2 may be implemented by a shunt diode or MEMS switch.

Figure 9:
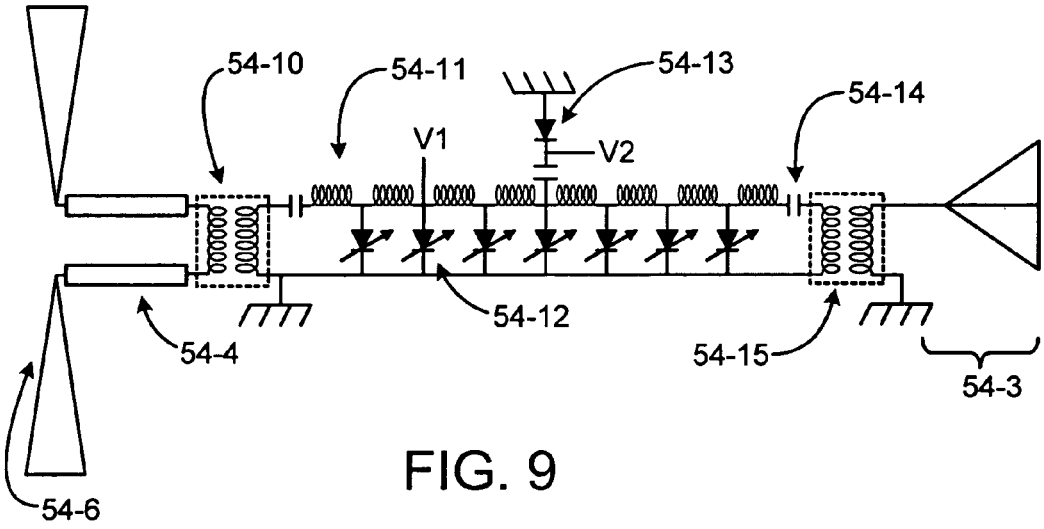
FIG. 9 is a schematic diagram of an exemplary embodiment of RF circuitry between a twin wire transmission line feed and a UHF long slot element.

In an exemplary embodiment of a UHF lens array, each UHF bow-tie dipole element 54-6 picks up power from the UHF feed array and transfers the power to a UHF long slot element 54-3 on the front face of substrate 54-2 via a twin wire transmission line feed 54-4. FIG. 9 is a schematic diagram of an exemplary embodiment of RF circuitry between a twin wire transmission line feed 54-4 and a long slot element 54-3. A lumped element balun 54-10, varactor diodes 54-12, a PIN diode 54-13, DC blocking capacitors 54-14 and inductors 54-11 are packaged as surface mounted devices (SMD) and are mounted on top of a multilayer RF flexible circuit board comprising substrate 54-2. A microstrip line may used to connect the SMD s together to form a switched varactor lumped element filter phase shifter circuit. A shift in transmission phase through the lumped element filter is the result of changing the capacitance of the varactor as the bias voltage is varied across the varactor devices. The PIN diode 54-13 serves a shunt switch in the center of the phase shifter circuit. Each end of the phase shifter circuit is connected to the single ended ports of the baluns 54-10 and 54-15 which essentially are lumped element transformers that provides impedance matching and transmission line mode conversion to both the orthogonally mounted twin wire line and coplanar long slot element at their respective probe points.

Figure 10:
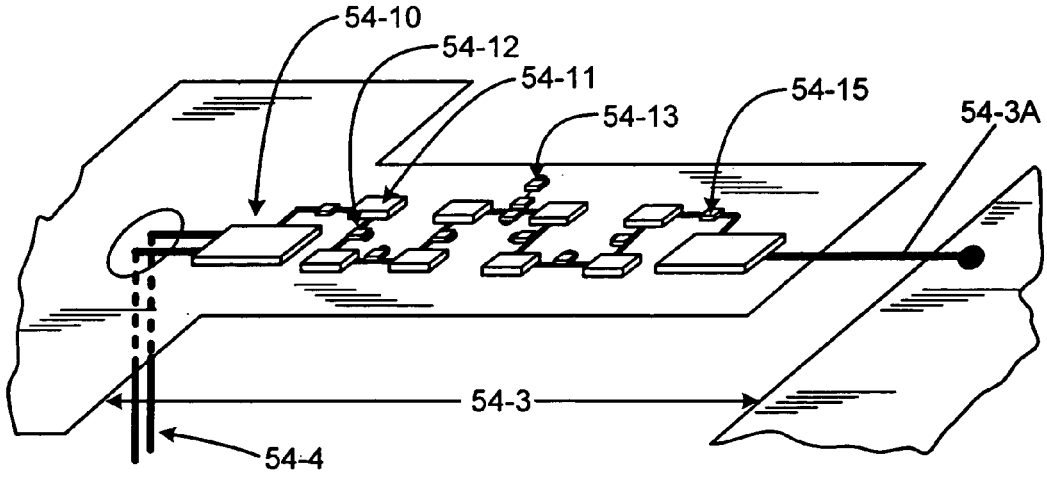
FIG. 10 diagrammatically depicts an exemplary embodiment of placement of phase shifter and balun circuitries across a portion of a UHF long slot radiator.

The SMDs and the resulting phase shifter circuits may be relatively small in comparison to the dimension of the gap across the UHF long slot 54-3. As a result the phase shifter and balun circuitries may be placed across a portion of the gap, as depicted diagrammatically in FIG. 10, on one side at the long slot probe point while running a trace 54-3A to the side of the gap to excite the voltage potential across the gap at the probe point to generate the radiating fields.

The DC bias circuits for the varactor and PIN diodes, and the signal and control lines to the phase shifter circuits are not shown in FIG. 9. In an exemplary embodiment, the signal and control lines may be buried within the multilayer RF flex circuit board and routed to the surface via plated through holes.

FIG. 11 is a schematic diagram of an exemplary embodiment of X-band lens array circuitry. The X-band lens element circuitry may include microstrip transmission line components 54-20, varactor diodes 54-21, a PIN diode 54-22 and DC blocking capacitors 54-23. These components may be used to make up flared dipole baluns 54-25 and switched varactor diode reflection phase shifter circuit 54-26. The varactor diodes may be used in branchline coupler circuits 54-24. As shown in FIG. 11, the reflection phase shifter circuit 54-26 employs a set of microstrip 3 dB branchline quadrature couplers 54-24 whose outputs are terminated with the varactor diodes 54-21. The shift in reflection phase off the diode termination is the result of changing the capacitance of the varactor, as the bias voltage is varied across the varactor. Other quadrature coupler configuration may alternatively be used.

In an exemplary embodiment, a PIN diode 54-22 serves as a shunt switch in the center of the phase shifter circuit 54-26. The balun circuit 54-25 includes a microstrip 0 degree/180 degree power divider with transmission line transformers to provide impedance matching and transmission line mode conversion from microstrip line to coupled microstrip on the RF flexible circuit board to the orthogonally mounted coplanar strips transmission lines that feed the dipoles. Other balun configurations may alternatively be used.

In an exemplary embodiment, to ensure adequate fit of the microstrip phase shifter circuitry within the X-band lattice, half of the phase shifter circuit 54-26 may be mounted on the surface of the RF flexible circuit board (substrate 54-2) with the radiating dipole elements 54-9 while the other half is mounted on the opposite surface of the RF flexible circuit board with the pick-up dipole elements 54-8. The PIN diode shunt switch 54-22 may be mounted on the RF flexible circuit board surface 54-27 facing the pick-up elements 54-8. The RF connections between the two phase shifter circuit halves may be accomplished using a set of plated through holes configured in the form of a caged coaxial interconnect line 54-30, illustrated in FIGS. 12 and 12A-12C. The interconnect line 54-30 includes an input microstrip conductor line 54-31 having a terminal end 54-31A which is connected to a plated via 54-32 extending through the substrate 54-2. A pattern of surrounding ground vias and pads 54-33 and connection pattern 54-34 provides a caged coaxial pattern pad 54-35. An output microstrip conductor 54-36 had a terminal end connected to the plated via 54-32 on the opposite side of the substrate, and a pattern of surrounding pads and connection pattern 54-37, 54-38 is formed. Spaced microstrip ground planes 54-39 and 54-40 are formed in buried layers of the substrate 54-2.

Figure 13A:
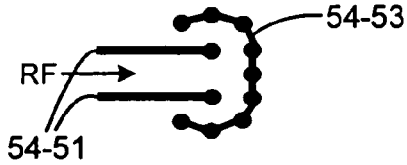
FIGS. 13 and 13A-13D are schematic diagrams illustrating an exemplary embodiment of a coupled microstrip transition to orthogonally mounted coplanar strip (CPS) transmission line.
Figure 13B:
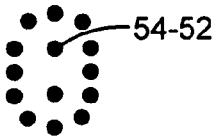
Figure 13C:
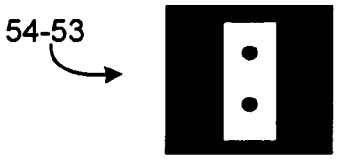
Figure 13D:
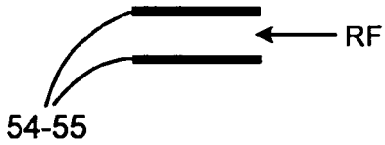
Figure 13:
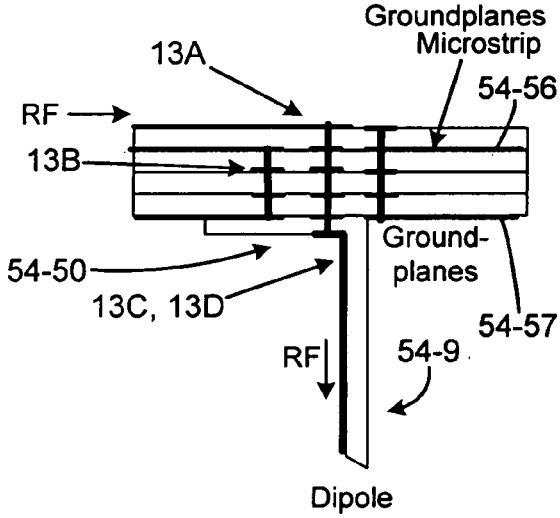

Using a similar caged coaxial approach, a coupled microstrip on the RF flexible circuit board surface can transition to orthogonally mounted coplanar strip (CPS) transmission line as shown in FIGS. 13 and 13A-13D. In this exemplary embodiment, input coupled microstrip conductor lines 54-51 and a surrounding connected ground plane vias and pad pattern 54-53 are formed on one surface of the substrate 54-2. A caged twin wire line pattern 54-52 is formed by the plated vias and surrounding ground vias (FIG. 13B), thus defining a shielded twin wire line 54-53 as depicted in FIG. 13C. On the opposite substrate surface, coplanar strips 54-55 with an orthogonal H-plane bend are connected to the twin leads to form an electrical RF connection to the dipole 54-8. Microstrip groundplanes 54-56, 54-57 are disposed in a buried layer within the substrate and on a surface of the substrate. Note that the DC biased circuits and the signal and control lines to the phase shifter circuits are not shown. The signal and control lines may be buried within the multilayer RF flexible circuit board and routed to the surface via plated through holes.

Aspects of embodiments of the disclosed subject matter may include one or more of the following:

The use of a space feed to reduce RF loss and feed complexity to power a large number, e.g. in one exemplary embodiment, 4 million, X-band radiating elements.

Interleaving of UHF and X-band radiating elements over the same aperture.

Dual band operation over X band and UHF bands, with the frequency ratio 20:1 for X and UHF.

Application of long slot elements to accommodate shared aperture.

Exploitation of polarization twist to isolate high band, low band, and between the pick-up side and the radiating side of the lens array.

Use of feed-through and reflective modes to cover both forward and backward directions.

Although the foregoing has been a description and illustration of specific embodiments of the subject matter, various modifications and changes thereto can be made by persons skilled in the art without departing from the scope and spirit of the subject matter as defined by the following claims.

What is claimed is:

1. A space-fed conformal array for a high altitude airship including an inflatable skin, comprising:

a primary array lens assembly configured for conformal mounting to a non-planar airship surface, said surface including said inflatable skin, said lens assembly comprising a first set of radiator elements and a second set of radiator elements, the first set and the second set being spaced apart by a spacing distance, the first set facing outwardly from the airship surface to form a radiating aperture, the second set facing inwardly toward an inner space of the airship; and a feed array spaced from the second set of radiators and arranged to illuminate the second set of radiators, the feed array comprising a plurality of rows of radiating elements to produce a feed pattern in an elevation plane, each row including a plurality of radiating elements, and having a longitudinal extent along a longitudinal extent of the primary array lens assembly.

2. The array of claim 1, wherein said lens assembly and said feed array operate in a UHF frequency range.

3. The array of claim 1, wherein said lens assembly and said feed array operate in an X-band range.

4. The array of claim 1, wherein the airship has opposed first and second flanks on opposite sides of the inner space of the airship, and said primary array lens assembly is mounted on the first flank of the airship surface.

5. A space-fed conformal array for a high altitude airship having opposed first and second flanks on opposite sides of an inner space of the airship, the airship having a longitudinal axis, the array comprising:

a primary array lens assembly adapted for conformal mounting to a non-planar airship surface, said primary array lens assembly mounted on the first flank of the airship surface, said lens assembly comprising a first set of radiator elements and a second set of radiator elements, the first set and the second set being spaced apart by a spacing distance, the first set facing outwardly from the airship surface to form a radiating aperture, the second set facing inwardly toward the inner space of the airship; and a feed array spaced from the second set of radiators and arranged to illuminate the second set of radiators, wherein said feed array is mounted on said second flank of the airship surface, and wherein the feed array is an elongated array with a longitudinal extent along the longitudinal axis of the airship.

6. The array of claim 5, wherein said feed array is mounted in an upper area of the airship surface above an airship center.

7. The array of claim 4, wherein said feed array is mounted within said inner space of the airship.

8. The array of claim 1, wherein said first set of radiators is fabricated on one or more first dielectric substrates, and said second set of radiators is fabricated on one or more second dielectric substrates.

9. A space-fed conformal array for a high altitude airship including an inflatable skin, comprising:

a primary array lens assembly configured for conformal mounting to a non-planar airship surface, said surface including said inflatable skin, said lens assembly comprising a first set of radiator elements and a second set of radiator elements, the first set and the second set being spaced apart by a spacing distance, the first set facing outwardly from the airship surface to form a radiating aperture, the second set facing inwardly toward an inner space of the airship; and a feed array spaced from the second set of radiators and arranged to illuminate the second set of radiators, the feed array comprising a plurality of rows of radiating elements to produce a feed pattern in an elevation plane, each row including a plurality of radiating elements, and having a longitudinal extent along a longitudinal extent of the primary array lens assembly; and wherein said primary array lens assembly comprises a plurality of tile panels.

10. A space-fed array for a high altitude airship, comprising:

a primary array lens assembly configured for conformal mounting to an airship surface, said lens assembly comprising a first set of radiator elements and a second set of radiator elements, the first set and the second set being spaced apart by a spacing distance, the first set facing outwardly from the airship surface to form a radiating aperture, the second set facing inwardly toward an inner space of the airship; and an active feed array supported by the airship and spaced from the second set of radiators, said feed array arranged to illuminate the second set of radiators, the feed array comprising a plurality of rows of radiating elements to produce a feed pattern in an elevation plane, and having a longitudinal extent which is longer than a longitudinal extent of the primary array lens assembly.

11. The array of claim 10, wherein said lens assembly and said feed array operate in a UHF frequency range.

12. The array of claim 10, wherein said lens assembly and said feed array operate in an X-band range.

13. The array of claim 10, wherein the airship has opposed first and second flanks on opposite longitudinal sides of the inner space of the airship, and said primary array lens assembly is mounted on the first flank of the airship surface.

14. A space-fed array for a high altitude airship having opposed first and second flanks on opposite longitudinal sides of an inner space of the airship the airship having a longitudinal axis, comprising:

a primary array lens assembly adapted for mounting on the first flank of the airship surface, said lens assembly comprising a first set of radiator elements and a second set of radiator elements, the first set and the second set being spaced apart by a spacing distance, the first set facing outwardly from the airship surface to form a radiating aperture, the second set facing inwardly toward an inner space of the airship; and a feed array supported by the airship and spaced from the second set of radiators, said feed array arranged to illuminate the second set of radiators, wherein said feed array is mounted on said second flank of the airship surface, and wherein the feed array is an elongated array with a longitudinal extent along the longitudinal axis of the airship.

15. The array of claim 14, wherein said feed array is mounted in an upper area of the airship surface above an airship center.

16. The array of claim 13, wherein said feed array is mounted within said inner space of the airship.

17. The array of claim 10, wherein said first set of radiators is fabricated on one or more first dielectric substrates, and said second set of radiators is fabricated on one or more second dielectric substrates.

18. A space-fed array for a high altitude airship, comprising:

a primary array lens assembly configured for conformal mounting to an airship surface, said lens assembly comprising a first set of radiator elements and a second set of radiator elements, the first set and the second set being spaced apart by a spacing distance, the first set facing outwardly from the airship surface to form a radiating aperture, the second set facing inwardly toward an inner space of the airship; and an active feed array supported by the airship and spaced from the second set of radiators, said feed array arranged to illuminate the second set of radiators, the feed array comprising a plurality of rows of radiating elements to produce a feed pattern in an elevation plane, and having a longitudinal extent which is longer than a longitudinal extent of the primary array lens assembly; and wherein said primary array lens assembly comprises a plurality of tile panels.

19. The array of claim 10, wherein said airship includes a flexible dielectric skin, and wherein said primary array is mounted to said skin.

20. The array of claim 10, wherein the longitudinal extent of the feed array is at least 30 meters.

21. The array of claim 1, wherein the longitudinal extent of the feed array exceeds the longitudinal extent of the primary array lens assembly.

22. The array of claim 21, wherein the longitudinal extent of the feed array is at least 30 meters.

23. The array of claim 1, further comprising:

a second primary array lens assembly configured for mounting inside the inner space of the airship on a bulkhead in a nose region to provide antenna coverage of front and back regions relative to the airship, the first primary array lens mounted on a flank of the airship to provide antenna coverage of left and right side regions relative to the airship, said second lens assembly comprising a third set of radiator elements and a fourth set of radiator elements, the third set and the fourth set being spaced apart by a spacing distance; and a second feed array spaced from the third set of radiators and arranged to illuminate the third set of radiators.

* * * * *